US007124686B2

(12) United States Patent
Behrens et al.

(10) Patent No.: US 7,124,686 B2
(45) Date of Patent: Oct. 24, 2006

(54) APPARATUS FOR CLAMPING AND HOLDING A PRINTING PLATE ON AN EXPOSURE DRUM

(75) Inventors: Gunnar Behrens, Kiel (DE); Bernd Friedrich Deutschbein, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/064,308

(22) Filed: Feb. 23, 2005

(65) Prior Publication Data

US 2005/0241514 A1 Nov. 3, 2005

(30) Foreign Application Priority Data

Apr. 28, 2004 (DE) ..... 10 2004 020 694

(51) Int. Cl.
*B41F 27/12* (2006.01)

(52) U.S. Cl. ..... 101/389.1; 101/415.1; 101/409; 271/276

(58) Field of Classification Search ..... 101/409, 101/410, 477, 415.1, 389.1, 401.1, 378; 271/275, 276, 277, 82; 346/138, 132, 134
See application file for complete search history.

(56) References Cited

U.S. PATENT DOCUMENTS

| | | | | |
|---|---|---|---|---|
| 2,061,525 | A * | 11/1936 | Storck | 101/132.5 |
| 2,622,000 | A * | 12/1952 | Thompson | 346/138 |
| 2,674,943 | A * | 4/1954 | Freeman | 101/269 |
| 5,335,046 | A * | 8/1994 | Bosy | 355/73 |
| 6,003,442 | A | 12/1999 | Solomon et al. | 101/415.1 |
| 6,189,452 | B1 | 2/2001 | Halup et al. | 101/415.1 |
| 6,260,482 | B1 | 7/2001 | Halup et al. | 101/477 |
| 6,435,091 | B1 | 8/2002 | Halup et al. | 101/415.1 |
| 6,561,510 | B1 * | 5/2003 | Ozaki | 271/276 |
| 6,572,104 | B1 | 6/2003 | Fukui | 271/277 |
| 6,705,226 | B1 | 3/2004 | McManus | 101/409 |
| 6,729,234 | B1 | 5/2004 | Shih | 101/389.1 |
| 6,736,396 | B1 | 5/2004 | Fukui | 271/275 |
| 2001/0032561 | A1 | 10/2001 | Halup et al. | 101/415.1 |
| 2002/0014174 | A1 | 2/2002 | Rombult et al. | 101/415.1 |
| 2002/0014553 | A1 | 2/2002 | Fukui | 242/547 |
| 2003/0188654 | A1 | 10/2003 | Shih | 101/477 |

(Continued)

FOREIGN PATENT DOCUMENTS

DE 25 55 037 A1 6/1977

(Continued)

*Primary Examiner*—Leslie J. Evanisko
(74) *Attorney, Agent, or Firm*—Laurence A. Greenberg; Werner H. Stemer; Ralph E. Locher

(57) ABSTRACT

In the field of electronic reproduction technology, an apparatus for clamping and holding a printing plate on the surface of an exposure drum in a printing plate exposer includes a clamping apparatus for the front edge of the printing plate. The clamping apparatus has actuating elements that are accommodated in the interior of the exposure drum. Only the clamping bars that clamp the printing plate fixedly protrude slightly beyond the drum surface. Terminating elements are provided for holding the rear edge of the printing plate, which terminating elements can be displaced in the suction grooves of the drum surface and primarily restrict the vacuum that draws the printing plate onto the drum surface to the surface below the printing plate. Additionally, the terminating elements are provided with a roof element that protrudes beyond the rear edge of the printing plate and, thus, encloses the rear edge in the gap between the roof element and the exposure drum without, however, clamping it fixedly. Accordingly, devices for locking the terminating elements in their circumferential position are not required.

7 Claims, 2 Drawing Sheets

U.S. PATENT DOCUMENTS

2003/0189287 A1 10/2003 Fukui ..... 271/275

FOREIGN PATENT DOCUMENTS

EP 0 881 074 B1 12/1998
EP 1 176 796 A2 1/2002
EP 1 364 779 A2 11/2003
FR 2 784 470 A1 4/2000

* cited by examiner

APPARATUS FOR CLAMPING AND HOLDING A PRINTING PLATE ON AN EXPOSURE DRUM

BACKGROUND OF THE INVENTION

Field of the Invention

The invention pertains to the field of electronic reproduction technology and relates to an apparatus for clamping and holding a printing plate on the surface of an exposure drum in a printing plate exposer that records a printing original onto a printing plate.

In reproduction technology, printing originals are produced for printed pages, which printing originals contain all the elements to be printed such as text, graphics, and images. For color printing, a separate printing original is produced for each printing ink, the separate printing original containing all the elements that are printed in the respective color. For four-color printing, they are the print colors cyan, magenta, yellow, and black (CMYK). The printing originals are usually recorded onto printing plates in a printing plate exposer, and the printing plates are, then, used to print large runs of the printed pages in a printing press. As an alternative, the printing originals can be transferred directly to a digital printing press as digital data. There, the printing original data are, then, exposed onto printing plates, for example, using an exposure unit that is integrated into the printing press, before the printing of the edition begins immediately thereafter.

In the recording apparatuses that are used in electronic reproduction technology to expose printing plates, a laser beam is generated, for example, by a laser diode, shaped by optical measures and focused onto the printing plate and deflected over the printing plate point by point and line by line by a deflection system. To increase the exposure speed, a bundle of laser beams can also be generated, and a plurality of image lines are exposed simultaneously each time they sweep across the printing plate. The printing plate can be situated on an exposure drum (external drum exposer), in a cylindrical recess (internal drum exposer), or on a flat surface (flatbed exposer). In an external drum exposer, for example, the printing plate to be exposed is fitted onto a rotatably mounted exposure drum. While the exposure drum rotates, an exposure head is moved axially along the drum at a relatively short distance. The exposure head focuses one or more laser beams onto the drum surface, the laser beams sweeping across the drum surface in the form of a tight helix. As such, one or more image lines is/are exposed during each revolution of the drum.

A number of concepts are known for fitting and holding printing plates fixedly on an exposure drum. The front edge of the printing plate is clamped fixedly by plate clamps that are usually fixed in position; the rear edge is fixed by removable or displaceable clamps. The terms front edge and rear edge are defined with regard to the rotational direction of the exposure drum during the exposure, the laser beams sweeping across the printing plate during each revolution starting at the front edge and ending at the rear edge. Devices that are disposed all the way around the exposure drum are provided to actuate the plate clamps. In addition, the printing plate is often held on the vacuum device using a vacuum device, the drum surface attracting the printing plate by suction through holes or grooves in the drum surface so that the printing plate is not detached during rotation by the centrifugal forces.

European Patent Application EP 1 364 779 A2 (corresponding to U.S. Pat. No. 6,729,234 and U.S. Patent Publication No. 2003/188654 to Shih) describes a configuration, in which the same actuator actuates clamping apparatuses for the front edge and for the rear edge of the printing plate. The clamping apparatuses for the front edge, in principle, include clamping levers whose pivot points lie above the drum surface. One end of the clamping lever presses on the front end of the printing plate with the aid of a spring force and clamps it fixedly as a result. The clamping apparatuses are released again using an actuator that can be lowered onto the free end of the clamping levers. Moreover, the free end of the clamping levers bears a weight. As a result, the clamping force is increased still further by the centrifugal force when the exposure drum rotates quickly. The rear end of the printing plate is fixed using a magnetic clamping rail that is placed onto the drum surface and removed again by the same actuator.

U.S. Patent Publication No. 2002/0014174 A1 to Rombult et al. proposes a rail for clamping the rear plate edge fixedly, which rail is connected to a vacuum device and sucks itself to the drum surface.

European Patent 0 881 074 B1 (corresponding to U.S. Patent Publication No. 2001/0032561 to Halup et al., and to U.S. Pat. No. 6,003,442 to Solomon et al., and U.S. Pat. Nos. 6,198,452, 6,260,482, 6,435,091 to Halup et al.) proposes apparatuses for clamping the front edge and the rear edge of the printing plate, which apparatuses act according to the principle of the clamping lever operating with spring force. At least the clamping levers for the rear edge can be displaced into circumferential grooves of the exposure drum for it to be possible to clamp printing plates of various formats.

European Patent Application EP 1 176 796 A2 (corresponding to U.S. Pat. Nos. 6,736,396 and 6,572,104 to Fukui and to U.S. Patent Publication Nos. 2002/014553 and 2003/0189287 to Fukui) discloses various embodiments of plate clamps that operate according to the clamping lever principle. The constructions differ from one another in the configuration of the clamping element at the part of the clamping lever that presses onto the printing plate. The document proposes a rotatably mounted clamping element, an obliquely displaceable clamping element, or a resilient clamping element. All the clamping elements are configured such that the clamping force is increased if, as a consequence of the centrifugal force, a tensile force that acts under the clamping element tangentially with respect to the exposure drum is exerted on the printing plate.

U.S. Pat. No. 6,705,226 B1 to McManus describes a clamping device for the front edge of the printing plate, leaf spring elements pressing the printing plate onto the drum surface. The spring elements can be lifted off to release the printing plate using a compressed air bellows that is situated between the leaf spring elements and the exposure drum. In another embodiment, a compressed air bellows that is recessed into a clamping bar presses the printing plate onto the exposure drum. In a further variant, the clamping bar has a slot for accommodating the printing plate. A compressed air bellows that is recessed into the drum surface presses the printing plate fixedly in the slot.

The known clamping apparatuses, in particular, the constructions that operate according to the clamping lever principle, have a disadvantage—they protrude to a considerable extent beyond the drum surface and, moreover, require actuators that have to be disposed outside the exposure drum. As a result, the available space for other subunits of the printing plate exposer is restricted. Moreover, the known plate clamps have a considerable mass. As a result, they can impart an unbalance to the drum rotation, which unbalance, in turn, makes an apparatus for compensating for the unbalance necessary. Furthermore, the known clamps or clamping bars for the rear edge of the printing plate have the function of likewise pressing the printing plate fixedly onto the drum surface. As these clamps also have to be displaceable, complicated mechanical devices are required with which, firstly, these clamps can be locked at a desired circumferential position and, secondly, can also be released again or removed completely.

SUMMARY OF THE INVENTION

It is accordingly an object of the invention to provide an apparatus for clamping and holding a printing plate on an exposure drum that overcomes the hereinafore-mentioned disadvantages of the heretofore-known devices of this general type and that clamps the printing plate fixedly on the exposure drum and hold it there without the disadvantages of the known clamping apparatuses, it being intended, in particular, that the clamping or holding apparatuses for the front edge and for the rear edge protrude only to a very slight extent beyond the drum surface.

With the foregoing and other objects in view, there is provided, in accordance with the invention, an exposure drum having an interior and for processing a printing plate having an edge, an apparatus for clamping the printing plate fixedly on the exposure drum, including a clamping bar positioned above the edge of the printing plate, a pull rod connected to the clamping bar, and a compression spring disposed in the interior of the exposure drum, the compression spring pulling the clamping bar onto the printing plate with the pull rod.

With the objects of the invention in view, in an exposure drum having at least one suction groove and for processing a printing plate on the exposure drum, the printing plate having an edge, there is also provided a an apparatus for holding the printing plate on the exposure drum, including a terminating element having a sliding element and a plug fastened to the sliding element, the terminating element fluidically sealing the suction groove with the plug and being displaced in the suction groove, and a roof element being disposed outside the suction groove, being tiltably connected to the sliding element, defining a gap with respect to the exposure drum, and enclosing the edge of the printing plate in the gap between the roof element and the exposure drum.

With the objects of the invention in view, in an exposure drum having an interior and at least one suction groove, the exposure drum processing a printing plate having edges, there is also provided an apparatus for at least one of clamping and holding the printing plate on the exposure drum, including a clamping bar positioned above at least one of the edges of the printing plate, a pull rod connected to the clamping bar, a compression spring disposed in the interior of the exposure drum, the compression spring pulling the clamping bar onto the printing plate with the pull rod, a terminating element having a sliding element and a plug fastened to the sliding element, the terminating element fluidically. sealing the suction groove with the plug and being displaced in the suction groove, and a roof element being disposed outside the suction groove, being tiltably connected to the sliding element, defining a gap with respect to the exposure drum, and enclosing the edge of the printing plate in the gap between the roof element and the exposure drum.

The invention provides a clamping apparatus for the front edge of the printing plate, the actuating elements of the clamping apparatus being accommodated in the interior of the exposure drum. Only the clamping bars, which press the printing plate against the drum surface, protrude slightly beyond the drum surface. As a result, no actuators situated outside the exposure drum are required for actuating the clamping apparatus. Terminating elements are provided for holding the rear edge of the printing plate, which terminating elements can be displaced in the vacuum grooves of the drum surface and primarily ensure that the vacuum that sucks the printing plate onto the drum surface, is restricted to the surface below the printing plate. The terminating elements are provided additionally with a roof element that protrudes beyond the rear edge of the printing plate and, thus, encloses the rear edge in the intermediate space between the roof element and the exposure drum. However, the printing plate is not pressed onto the drum surface using the roof elements, for which reason devices using the terminating elements would have to be locked in their circumferential position are not required.

In accordance with another feature of the invention, the compression spring exerts a first force upon the clamping bar and a flexible compressed-air tube is disposed in the interior of the exposure drum, the compressed-air tube selectively exerts a second force on the pull rod counter to the first force and, thereby, releases the clamping bar from the printing plate.

In accordance with a further feature of the invention, the roof element has a projection lying on the exposure drum and limiting a width of the gap between the roof element and the exposure drum.

In accordance with a concomitant feature of the invention, there is provided an actuating bar selectively connected to the roof element to tilt the roof element and, thereby, displace the terminating element in the suction groove when connected to the roof element.

Other features that are considered as characteristic for the invention are set forth in the appended claims.

Although the invention is illustrated and described herein as embodied in an apparatus for clamping and holding a printing plate on an exposure drum, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
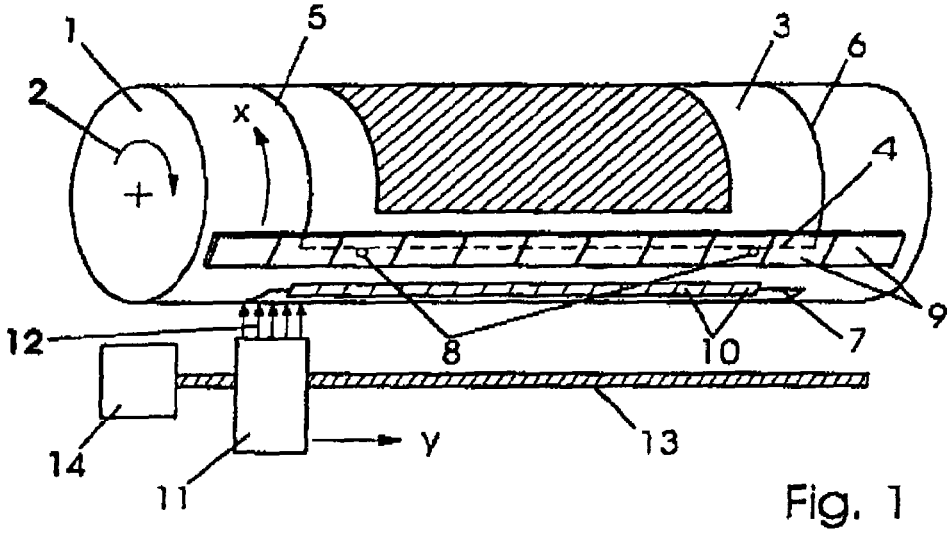
FIG. 1 is a diagrammatic, perspective view of a basic construction of an external drum exposer according to the invention.

Referring now to the figures of the drawings in detail and first, particularly to FIG. 1 thereof, there is shown the basic construction of an external drum exposer. An exposure drum 1 is rotatably mounted and can have a uniform rotational movement imparted to it in the direction of the rotation arrow 2 using a non-illustrated rotational drive. An unexposed, rectangular printing plate 3 is clamped onto the exposure drum 1, which printing plate 3 has a front side 4, a left-hand lateral edge 5, a right-hand lateral edge 6, and a rear edge 7. The printing plate 3 is clamped such that its front edge 4 touches contact pins 8 that are connected fixedly to the exposure drum 1 and that protrude beyond the surface of the exposure drum 1. Moreover, a plurality of clamping bars 9 press the front edge 4 firmly onto the surface of the exposure drum 1 and, as a result, fix the front edge 4 of the printing plate 3 in position. The printing plate 3 is held over its entire area on the drum surface by a vacuum device that attracts the printing plate 3 by suction through suction grooves (not illustrated in FIG. 1) in the drum surface so that the printing plate 3 is not detached by the centrifugal forces during rotation. Additionally, the rear edge 7 of the printing plate 3 is fixed in position using terminating elements 10.

An exposure head 11 is moved axially along the exposure drum 1 at a relatively short distance, while the exposure drum 1 rotates. The exposure head 11 focuses one or more laser beams 12 onto the drum surface, the laser beams 12 sweeping across the drum surface in the form of helixes that are close to one another. As such, one or more image lines is/are exposed onto the printing plate 3 in the circumferential direction x during each revolution of the drum. The exposure head 11 is moved in the feed direction y by a feed spindle 13 to which it is connected with a form-fitting connection and which is set moving rotationally using a feed drive 14.

Figure 2:
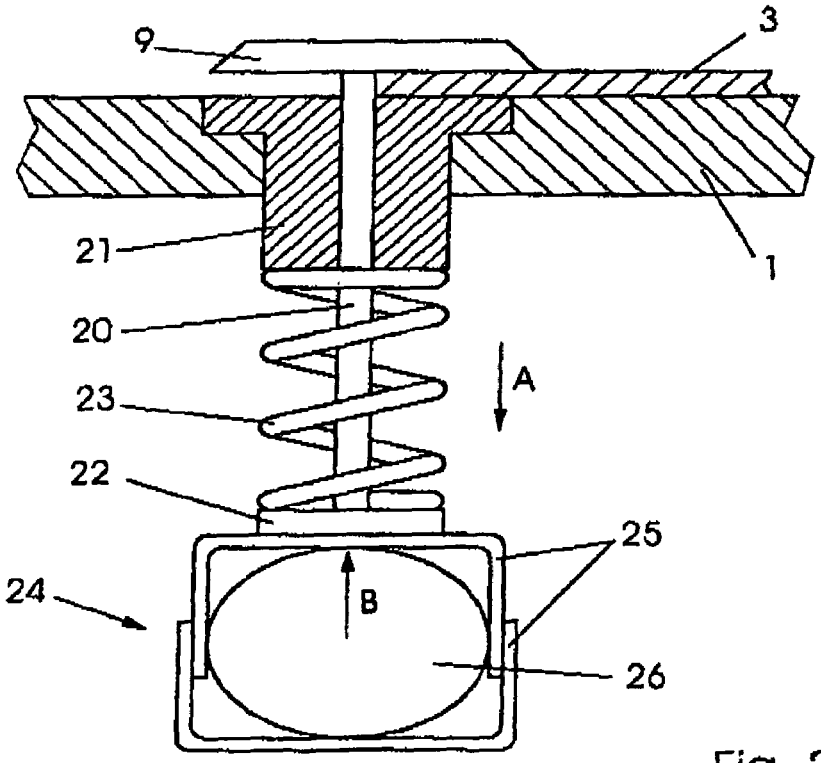
FIG. 2 is a fragmentary, enlarged cross-sectional view of a clamping apparatus according to the invention for a printing plate.

FIG. 2 shows a preferred embodiment of the clamping apparatus according to the invention for the front edge 4 of the printing plate 3 in a cross-sectional illustration through the drum surface. The printing plate 3 is pressed onto the exposure drum 1 by a clamping bar 9. The clamping bar 9 is connected to a pull rod 20 that is guided through a guide bushing 21 into the interior of the exposure drum. The pull rod 20 terminates at its lower end with a disk 22. A compression spring 23 is mounted between the guide bushing 21 and the disk 22. The compression spring 23 exerts a force on the disk 22 in the direction of the arrow A and, as a result pulls, the pull rod 20 and the clamping bar 9 in the direction of the arrow A. As a result, the printing plate 3 is clamped fixedly. A plurality of clamping bars 9 are disposed in the axial direction of the exposure drum 1 (FIG. 1), each clamping bar 9 contributing to the fixed clamping of the printing plate 3 by a compression spring 23 and a pull rod 20.

A clamping unit 24 is disposed below the disks 22 in the axial direction of the exposure drum 1, the clamping unit 24 including two U-profiles 25 that can be displaced inside one another and a flexible compressed air tube 26 enclosed in the U-profiles 25. If the flexible compressed air tube 26 is filled with compressed air, it exerts a force on all the pull rods 20 in the direction of the arrow B. As a result, all the clamping bars 9 are lifted up and the printing plate 3 is released. If the compressed air is switched off, the compression springs 23 pull the clamping bars 9 onto the drum surface or onto the printing plate 3 again. Moreover, they press the air out of the flexible compressed air tube 26. Additional non-illustrated compression springs that press onto the upper U-profile 25 from above can be provided to assist and accelerate the emptying of air.

The displacement into the interior of the exposure drum results in significant advantages for the clamping apparatus according to the invention—only its clamping bar 9 protrudes beyond the drum surface to a very slight extent and no actuating devices for clamping and releasing are required outside the exposure drum 1. A further advantage is that the clamping bars 9 are lowered vertically onto the printing plate 3 for clamping the front edge 4. As a result, there is no force component that acts tangentially with respect to the exposure drum 1 and that could displace the printing plate 3 during clamping and during release.

Figure 3:
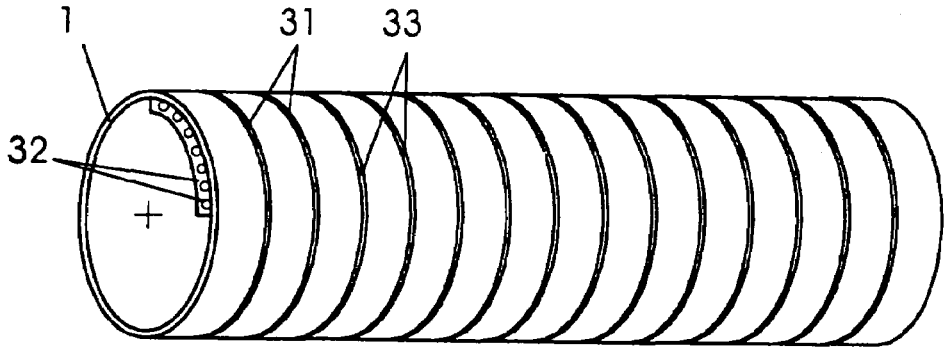
FIG. 3 is a diagrammatic, perspective view of an exposure drum according to the invention having suction grooves and suction channels.

It is assumed for the apparatus according to the invention for holding the rear edge 7 of the printing plate 3 that the printing plate 3 is held fixedly on the exposure drum 1 primarily using a vacuum device, the exposure drum 1 attracting the printing plate by suction through suction grooves. FIG. 3 shows a typical configuration of suction grooves 31 that are machined into the drum surface and extend in the circumferential direction of the exposure drum 1. The exposure drum 1 is configured as a hollow cylinder. Suction channels 32 that extend in the axial direction of the exposure drum 1 are machined on part of the inner surface of the hollow cylinder. The extent of some of the suction channels 32 is illustrated in the interior of the exposure drum 1. The suction grooves 31 in the drum surface are connected to the suction channels 32 by drilled holes 33.

According to the invention, terminating elements 10 are provided (FIG. 1) that can be displaced in the suction grooves 31 and are configured so that they seal off the suction grooves 31 and, thus, restrict the vacuum in the suction grooves 31 in the circumferential direction of the exposure drum 1 to the surface below the printing plate 3. In addition, the terminating elements 10 have the object of holding and securing the rear edge 7 of the printing plate 3 so that it cannot become detached from the drum surface. For such a purpose, the terminating elements 10 are provided with a tiltable roof element that can be pushed over the end of the printing plate and that encloses the rear edge 7 of the printing plate in a gap between the roof element and the drum surface. The terminating elements 10 are connected to one another so that they can be displaced jointly over the entire drum length more easily.

Figure 4:
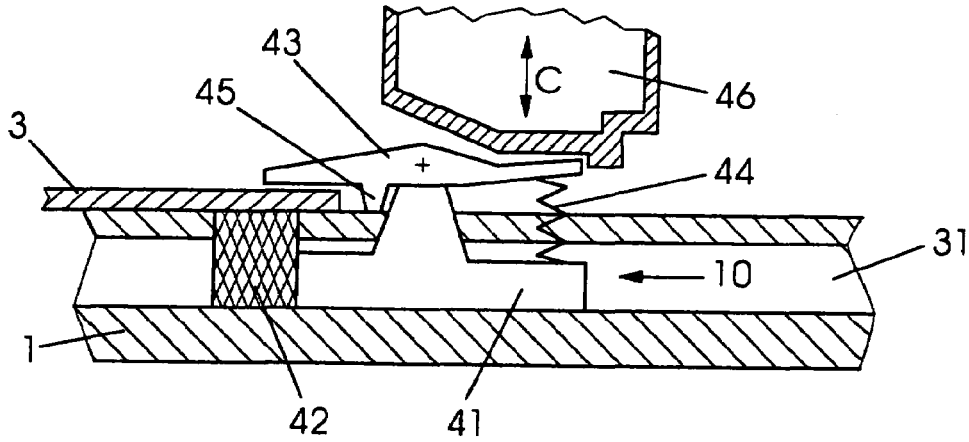
FIG. 4 is a fragmentary, enlarged cross-sectional view of a printing plate held using terminating elements according to the invention.

FIG. 4 shows a preferred embodiment of the terminating element 10 in a cross-sectional illustration. The terminating element 10 includes a sliding element 41 that can be displaced in the suction groove 31. A plug 42, preferably, made from a foam material, is situated at the front end of the sliding element 41. Through the plug 42, the suction groove 31 is sealed off so that the vacuum is restricted to the region below the printing plate 3. One part of the sliding element 41 that protrudes from the suction groove 31 is rotatably connected to a roof element 43 that is moved into the illustrated position of rest by a spring 44. In the position of rest, a projection 45 on the underside of the roof element 43 lies on the drum surface. As a result, a gap that is a little wider than the printing plate 3 is thick remains between that end of the roof element 43 that protrudes beyond the printing plate 3 and the drum surface. Accordingly, the terminating element 10 encloses the rear edge 7 of the printing plate 3 in the gap and secures it against detachment from the drum surface. However, the printing plate 3 is not clamped fixedly to the roof element 43, for which reason devices using which the terminating elements 10 would have to be locked in their circumferential position in the suction grooves 31 are not required.

To push the roof elements 43 beyond the end of the printing plate, an actuating bar 46 is provided that extends in the axial direction of the exposure drum 1 and that does not rotate together with the exposure drum 1. Only the lower part of the actuating bar 46 is shown in FIG. 4. The actuating bar 46 can be lowered and raised in the direction of the double arrow C. At its lower end, the actuating bar 46 is adapted to the shape of the roof elements 43 so that a form-fitting connection results when the actuating bar 46 is lowered onto the roof elements 43 and, thus, tilts the roof elements 43, the gap between the roof elements 43 and the drum surface, in the process, becoming larger. In the tilted position of the roof elements 43, the exposure drum 1 with the printing plate 3 attracted to it by suction is rotated slowly (to the right in FIG. 4) until the end of the plate lies under the roof elements 43. The actuating bar 46 is, then, lifted and the roof elements tilt back into the position of rest shown in FIG. 4. Although, theoretically, the printing plate 3 would also fit under the roof elements 43 in the position of rest, it is necessary to tilt the roof elements 43 because the edges of the printing plate 3 can be corrugated somewhat.

Figure 5:
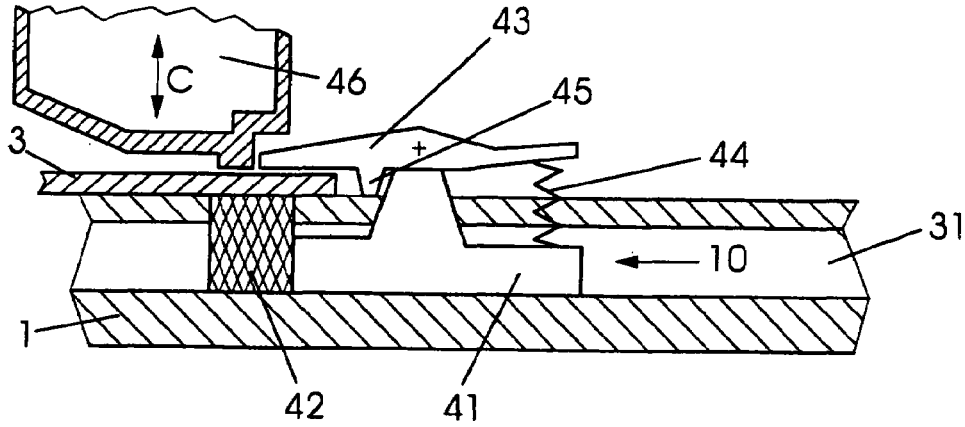
FIG. 5 is a fragmentary, enlarged cross-sectional view of the printing plate of FIG. 4 with the printing plate released from the terminating elements.

FIG. 5 shows how the terminating elements 10 are pushed down off the plate edge again. For this purpose, the actuating bar 46 is lowered in front of the roof elements 43. The exposure drum is, then, rotated slowly, to the left in FIG. 5. Here, the actuating bar 46 strikes the roof elements 43 and pushes them off the plate edge.

This application claims the priority, under 35 U.S.C. § 119, of German patent application No. 10 2004 020 694.5, filed Apr. 28, 2004; the entire disclosure of the prior application is herewith incorporated by reference.

We claim:

1. In an exposure drum having at least one suction groove and for processing a printing plate on the exposure drum, the printing plate having an edge, an apparatus for holding the printing plate on the exposure drum, comprising:

a terminating element having a sliding element and a plug fastened to said sliding element, said terminating element fluidically sealing the suction groove with said plug and being displaced in the suction groove; and a roof element:

being disposed outside the suction groove;

being tiltably connected to said sliding element;

defining a gap with respect to the exposure drum; and enclosing the edge of the printing plate in said gap between said roof element and the exposure drum.

2. The apparatus according to claim 1, wherein said roof element has a projection lying on the exposure drum and limiting a width of said gap between said roof element and the exposure drum.

3. The apparatus according to claim 1, further comprising an actuatinq bar selectively connected to said roof element to tilt said roof element and, thereby, displace said terminating element in the suction groove when connected to said roof element.

4. In an exposure drum having an interior and at least one auction groove, the exposure drum processing a printing plate having edges, an apparatus for at least one of clamping and holding the printing plate on the exposure drum, comprising:

a clamping bar positioned above at least one of the edges of the printing plate;

a pull rod connected to said clamping bar;

a compression spring disposed in the interior of the exposure drum, said compression spring pulling said clamping bar onto the printing plate with said pull rod;

a terminating element having a sliding element and a plug fastened to said sliding element, said terminating element fluidically sealing the suction groove with said plug and being displaced in the suction groove; and a roof element:

being disposed outside the suction groove;

being tiltably connected to said sliding element;

defining a gap with respect to the exposure drum; and enclosing the edge of the printing plate in said gap between said root element and the exposure drum.

5. The apparatus according to claim 4, wherein:

said compression spring exerts a first force upon said clamping bar; and a flexible compressed-air tube is disposed in the interior of the exposure drum, said compressed-air tube selectively exerts a second force on said pull rod counter to said first force and, thereby, releases said clamping bar from the printing plate.

6. The apparatus according to claim 4, wherein said roof element has a projection lying on the exposure drum and limiting a width of said gap between said roof element and the exposure drum.

7. The apparatus according to claim 4, further comprising an actuating bar selectively connected to said roof element to tilt said roof element and, thereby, displace said terminating element in the suction groove when connected to said roof element.

* * * * *